United States Patent [19]

Surface et al.

[11] Patent Number: 4,756,046

[45] Date of Patent: Jul. 12, 1988

[54] PAINTING ACCESSORY

[76] Inventors: James Surface, 1802 Kildare Dr., Redding, Calif. 96001; Gary LaFountain, 2101 Marshallfield La., Redondo Beach, Calif. 90278

[21] Appl. No.: 77,427

[22] Filed: Jul. 24, 1987

[51] Int. Cl.[4] ..... B44D 3/12

[52] U.S. Cl. ..... 15/257.06; 15/257 R; 220/90; 220/408; 220/410

[58] Field of Search ..... 15/257 R, 257.05, 257.06, 15/264; 220/90, 408, 410, 404

[56] References Cited

U.S. PATENT DOCUMENTS

| | | | |
|---|---|---|---|
| 3,157,902 | 11/1964 | Hardwick | 15/257.06 |
| 3,252,613 | 5/1966 | McGrath | 220/408 X |
| 4,142,973 | 10/1978 | Ahern | 220/404 |
| 4,145,789 | 3/1979 | Morgan | 15/257.06 |

FOREIGN PATENT DOCUMENTS

| | | | |
|---|---|---|---|
| 45527 | 2/1966 | German Democratic Rep. | 15/257.06 |

*Primary Examiner*—Edward L. Roberts

*Attorney, Agent, or Firm*—Charles H. Thomas

[57] ABSTRACT

A disposable stiff, plastic concave line having a circular floor and a frusto-conical wall is provided for a commercially available, reusable paint bucket of standardized configuration. The liner has a transverse floor rib and a pair of parallel wall ribs inclined relative to the floor. A paint rolling screen is removably insertable into the liner and is held immobile by the floor and wall ribs. The screen provides a means for rolling excess paint from a paint roller and the liner greatly reduces cleanup time following painting.

15 Claims, 1 Drawing Sheet

PAINTING ACCESSORY

BACKGROUND OF THE INVENTION

1. Field of the Invention

The present invention relates to an accessory designed for use by painters in association with a reusable paint bucket.

2. Description of the Prior Art

At present professional painters who paint interior and exterior building surfaces typically pour paint from containers in which the paint is sold into reusable two gallon or five gallon paint buckets of standardized configuration. The mouths of the standard size reusable paint buckets which are commercially available are large enough so that a paint roller can be dipped into paint in the bucket and used to spread the paint. This avoids the inconvenience of repeatedly having to pour paint from a bucket into a paint tray in order to roll paint onto a surface.

At present, professional painters spend considerable time cleaning up their reusable paint buckets for reuse following completion of work at the end of the day. Since paint is likely to have caked and at least partially dried on the walls of the bucket, particulary the upper regions of the walls, considerable time is expended in cleaning the buckets. This cleaning time adds to the inconvenience and cost of completing a painting project.

A further problem which is encountered in painting with a roller from reusable buckets is that excess paint tends to accumulate on the roller when the roller is dipped into the open bucket. The presence of excess paint on the roller increases the time required to paint a surface of a given area since paint must be spread from one area of the surface to another to prevent paint from being applied in an unduly thick coat. If paint is not spread sufficiently it will form droplets and rivulets which detract from the aesthetic appearance of the painted surface. Also, an undue accumulation of paint on the roller results in excessive dripping of paint in the work area. This leads to an unnecessarily large consumption of paint and also increases the time required for cleanup.

SUMMARY OF THE INVENTION

In one broad aspect the present invention is an accessory for a reusable paint bucket. The accessory of the invention is comprised of a concave, disposable liner configured for insertion into a reusable paint bucket. The liner has a circular floor and an upright wall rising from the floor to form an open mouth. At least a pair of inwardly directed, mutually parallel wall ribs are formed in the upright wall in spaced separation from each other. Also, an upwardly directed floor rib is formed in the floor between the wall ribs. The accessory of the invention also includes a flat paint screen configured for insertion into the paint bucket liner in lodged, removable engagement with the ribs, whereby the ribs together hold the screen immobilized at an inclined orientation within the bucket.

Both the screen and the liner of the invention are disposable, and are designed to be sold together as a unit. The screen is removable from the liner and is normally removed when paint is mixed and thinned within the liner once the liner is placed in a reusable paint bucket. Once mixing and thinning have been completed, the screen is inserted into the liner through the open mouth thereof. The screen is held immobile within the liner by the two wall ribs on opposite sides of the screen and by the floor rib at the bottom of the screen. The paint bucket is preferably only partially filled during use, so that the screen projects upwardly at an inclination above the level of paint in the liner. The upper portion of the screen thereby serves as a grate across which a paint roller can be rolled to press excess paint from the roller. The excess paint is pressed through the interstices in the screen and drops back into the liner.

The removable assembly of the screen with the liner also reduces the expense of packaging the component elements of the accessory of the invention. Each liner constructed according to the invention is preferably formed with a tapered draft from its open mouth to its floor, so that the wall of the liner rises in an annular frusto-conical configuration. With such a construction a plurality of the liners may be stored in nested fashion, one inside another. A plurality of such liners may thereby be stacked together. The screens for all of the liners in each stack are placed within the concave receptacle formed by the uppermost liner in the stack. The liners and the screens may thereby be compactly packed together and compactly displayed for sale at retail outlets with a minimum requirement for shelf and storage space.

While the accessory of the invention is designed for use with a reusable paint bucket, it may also be utilized to advantage with other liquid materials which are rolled onto surfaces with a paint roller. For example, the accessory of the invention has considerable utility in the application of resins, glues, mastics, stucco patching material, cement, linseed oil and numerous other liquid materials.

The liner of the invention is preferably vacuum formed from an inexpensive plastic, such as polyethylene or polyvinyl chloride. The liner is preferably formed from a sheet of material having uniform thickness throughout for ease of fabrication. The ribs which are formed in the floor and in the wall of the liner project inwardly as convex protrusions into the concave receptacle or cavity defined within the liner. Since the liner is of a uniform thickness throughout, corresponding concave indentations or grooves are defined in the outer surface of the liner opposite the locations on the inner surface at which each of the ribs is formed.

The liner of the invention is preferably formed with a radially outwardly turned lip at its open mouth. The lip is adapted to extend over the rim of a reusable paint bucket. When the liner of the invention is formed with a lip in this fashion, paint is less likely to drip from the liner into the reusable paint bucket when the liner is removed for disposal. Furthermore, the liner is thin enough so that the lid of the reusable paint bucket will fit on top of the liner to entrap the liner lip against the rim of the bucket when paint is to be stored temporarily for further use in completing a painting project.

The various features of the several elements of the invention combine to provide an accessory for painting with a reusable paint bucket which provides considerable savings in time, due to the significantly reduced time required for cleanup. The accessory of the invention also provides an economical savings in packaging, storage and display for sale of the painting accessory.

The invention may be described with greater clarity and particularity by reference to the accompanying drawings.

DESCRIPTION OF THE EMBODIMENT

Figure 1:
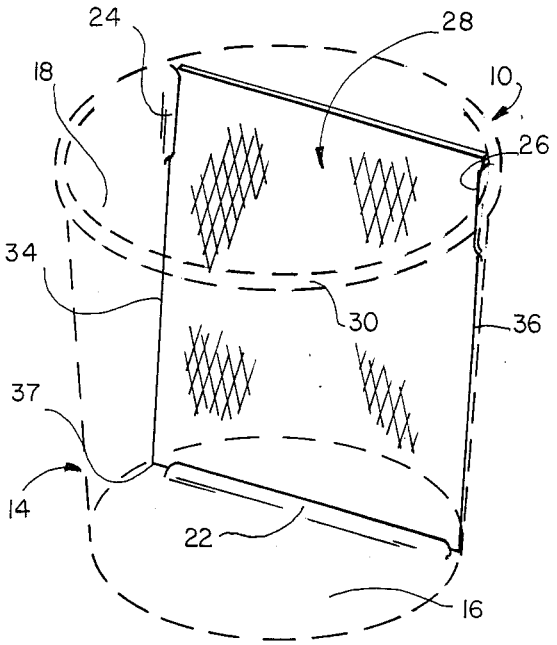
FIG. 1 is a perspective view illustrating the painting accessory of the invention with the liner thereof shown in phantom.
Figure 2:
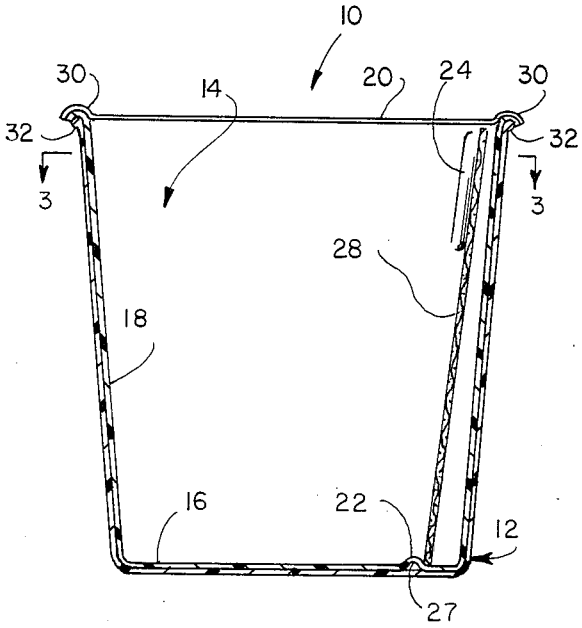
FIG. 2 is a side sectional view showing the accessory of the invention in use with a reusable paint bucket.
Figure 3:
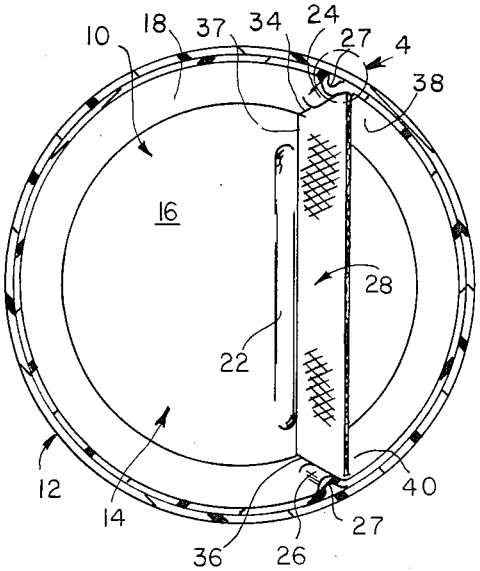
FIG. 3 is a sectional plan view taken along the lines 3—3 of FIG. 2.

FIG. 1 illustrates an embodiment of the improved accessory of the invention indicated generally at 10. The accessory 10 is adapted for use with a reusable paint bucket 12 as illustrated in FIGS. 2 and 3. The accessory 10 is comprised of a removable, disposable, concave liner 14 shaped to fit into and conform to the interior surface of the reusable paint bucket 12. The liner 14 is depicted in phantom in FIG. 1 to facilitate illustration of a screen 28 located therewithin. The liner 14 is constructed of vacuum formed plastic such as polyvinyl chloride or polyethylene. The plastic liner 14 is preferably of a uniform thickness throughout, and may, for example, be approximately ten mils in thickness. The liner 14 is formed with a circular floor 16 and an annular wall 18 of frusto-conical configuration rising upwardly from the floor 16 to form an open circular mouth indicated at 20. A stiff, elongated transverse ridge-like floor rib 22 projects upwardly from the floor 16 and a pair of stiff, parallel ridge-like wall ribs 24 and 26 are located on the wall 18 in spaced separation from each other, as illustrated in FIGS. 1 and 3. Both of the wall ribs 24 and 26 reside in coplanar relationship with the floor rib 22, as is evident from FIG. 2. Since the liner 14 is of a uniform thickness throughout, slight indentations or grooves 27 are defined in the outer surface of the liner 14 opposite the inner surface at which the ribs are formed.

The accessory 10 is further comprised of a flat, paint rolling screen 28 which is removably insertable into the liner 14 and which is held immobile within the liner 14 by the floor rib 22 and the wall ribs 24 and 26, as best depicted in FIGS. 1 and 3. As illustrated in FIG. 2, the liner floor 16 is flat and the wall ribs 24 are oriented at an acute angle of preferably between about eighty and eighty five degrees relative thereto.

The liner 14 is of a generally cup-shaped configuration and is shaped to fit into and conform to the interior surface of a conventional reusable paint bucket 12 of the type utilized by professional painters. Professional painters typically use reusable paint buckets 12 which are widely sold in two uniform standard sizes and shapes. Paint buckets of five gallon and two gallon capacity ar those which are most widely employed. The most popular five gallon paint bucket 12 is of frusto-conical configuration and is about twelve inches in diameter at its top, about ten inches in diameter at its bottom and about fourteen and one-half inches in height. The liner 14 is constructed with a size and shape which conforms to the geometry of the interior surface of the reusable paint bucket 12, except where the floor rib 22 and the wall ribs 24 and 26 project inwardly into the cup-shaped cavity defined by the liner 14. The liner 14 is preferably just stiff enough to hold its own shape when removed from the reusable paint bucket 12, but with a minimal wall thickness so as to effectuate the greatest economy in material cost.

At the open mouth 20 of the liner 12 there is a radially outwardly turned lip 30 which wraps over the top of the rim or bead 32 of the reusable bucket 12. The presence of the lip 30 aids in preventing paint from dripping back into the bucket 12 when the liner 14 is removed for disposal. Also, when a painting project is not yet complete and paint is to be stored overnight, the lid of the bucket 12 can be placed over the bucket without removing the liner 14. The conventional fastening tangs of the bucket lid can be bent over the lip 30 to sandwich the lip 30 between the bucket rim 32 and the lid of the bucket which is not depicted. The seal thus effectuated is sufficiently airtight to maintain a quantity of paint within the cavity defined by the liner 14 in a fresh condition for a reasonable period of time.

Figure 4:
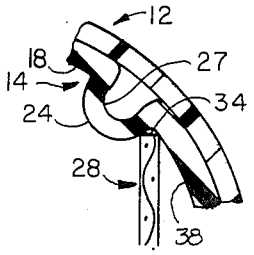
FIG. 4 is an enlarged detail indicated at 4 in FIG. 3.

The screen 28 which is employed as part of the accessory 10 for use with a five gallon bucket 12 is generally of a rectangular configuration and is preferably about nine and seven-eighths inches in width and thirteen and one-half inches in length. The screen 28 is inserted into the liner 14 through the liner mouth 20 and is moved downwardly and secured with its side edges 34 and 36 engaged between the wall ribs and the liner wall. That is, as best illustrated in FIG. 4, the edge 34 of the screen 28 is entrapped in immobilzed fashion between the interior surface 38 immediately adjacent to the wall rib 24 of the liner wall 18 and the convex protrusion of the wall rib 24 into the liner cavity. Likewise, the edge 36 of the screen 28 is laterally entrapped between the inner liner wall surface 40 immediately adjacent to the wall rib 26 and the convex protrusion of the wall rib 26 into the liner cavity. The lower edge 42 of the screen 28 is likewise entrapped and immobilized between the surface of the floor 16 and the upwardly convex protrusion of the floor rib 22.

The screen 28 is preferably wider between its edges 34 and 36 than the distance of separation of the interior surfaces 38 and 40 of the wall 18 immediately adjacent to the side ribs 24 and 26. As a result, it is necessary to flex or bow the screen slightly while inserting the screen 28 into the operative position depicted in FIGS. 1-3. When the screen 28 is released following insertion, it is held by the wall ribs 24 and 26 in an elastically flexed condition. The elastic, spring force tending to return the screen 28 to its flat, unflexed condition aids in immobilizing the screen 28 relative to the liner 14. The screen is preferably flexed outwardly toward the center of the liner 14, which is toward the left as viewed in FIGS. 2 and 3, to achieve this flexed condition. When the screen 28 is flexed in this fashion it remains bowed very slightly inwardly toward the axis of symmetry of the bucket 12. As a result, when a paint roller is pressed against the screen 28, toward the right as viewed in FIGS. 2 and 3, a resultant force is exerted outwardly along the opposite edges 34 and 36 and further aids in stabilizing the screen 28 within the bucket liner 14.

The accessory 10 is depicted in the condition in which it is utilized with the reusable paint bucket 12 in FIGS. 2 and 3. Because the liner 14 covers and conforms to the interior surface of the reusable bucket 12, the liner 14 protects the interior surface of the paint bucket 12 from contact with paint that is poured into the cavity defined by the liner 14. When painting is complete or halted at the end of the day, the liner 14 and the screen 28 are removed and discarded. Little or no paint contacts the interior surface of the reusable paint bucket 12, so that the time required to effectuate cleanup is greatly reduced.

On some occasions it may be desirable to store paint within the liner 14 for relatively short periods of time, such as overnight. In such a situation the screen 28 is left in position within the liner 14 and the cover for the paint bucket 12 is simply secured over the mouth 20 of the liner 14 with the liner lip 30 sandwiched between the bucket lid and the bucket rim 32.

Figure 5:
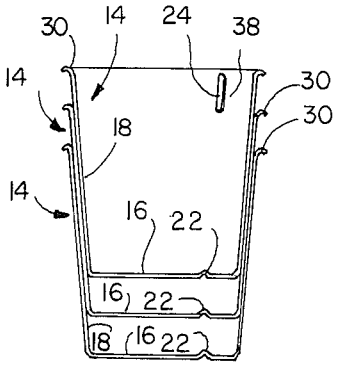
FIG. 5 is a sectional elevational view illustrating the manner in which the liners of the accessory of the invention stack together.

Each liner 14 is constructed with a tapered draft from its open mouth 20 to its floor 16, so that the mouth 20 is of a greater diameter than the floor 16. As a result of this construction a plurality of the liners 14 can be stored in nested fashion, one inside another as depicted in FIG. 5. The screens 28 for all of the liners 14 in the stack depicted in FIG. 5 can then be placed in the open cavity of the uppermost of the liners 14 depicted in that drawing figure.

Undoubtedly, numerous variations and modifications of the invention will become readily apparent to those familiar with painting accessories. Accordingly, the scope of the invention should not be construed as limited to the specific embodiment depicted and described, but rather is defined in the claims appended hereto.

We claim:

1. An accessory for a reusable paint bucket comprising a concave, disposable liner configured for insertion into a reusable paint bucket and having a circular floor and an upright wall rising from said floor to form an open mouth and with at least a pair of inwardly directed, mutually parallel wall ribs formed in said upright wall in spaced separation from each other, and an upwardly directed floor rib formed in said floor between said wall ribs, and a flat paint screen configured for insertion into said paint bucket liner in lodged, removable engagement with said ribs, whereby said ribs together hold said screen immobilized at an inclined orientation within said bucket.

2. An accessory according to claim 1 wherein said liner is formed with an outwardly turned lip at its open mouth adapted to extend over a rim of a paint bucket.

3. An accessory according to claim 2 wherein said liner is of uniform thickness throughout.

4. An accessory according to claim 3 wherein said ribs all reside in a coplanar relationship.

5. An accessory according to claim 4 wherein said screen is wider than the distance of separation of the interior surfaces of said side wall adjacent to said wall ribs, whereby said screen is held by said wall ribs in an elastically flexed condition.

6. An accessory according to claim 4 wherein said liner is constructed with a tapered draft from said open mouth to said floor, whereby a plurality of said liners are storable in nested fashion, one inside another.

7. In an accessory designed for use with a reusable paint bucket including a removable, disposable liner formed to define a concave cavity and having a floor of circular configuration from which a frusto-conical wall rises to form an open mouth, the improvement comprising at least one floor rib formed in said floor and extending toward opposite sides of said wall and at least a pair of wall ribs, each of which protrudes laterally into said cavity, and a paint roller screen removably positioned in said cavity and held in an immobile, inclined disposition by said floor rib and by said wall ribs.

8. An accessory according to claim 7 wherein said liner is of a uniform thickness throughout.

9. An accessory according to claim 8 wherein said liner includes an outwardly directed lip at said open mouth.

10. An accessory according to claim 9 wherein said width of said screen is greater than the distance of separation of said opposite sides of said wall adjacent to said wall ribs, whereby said screen is elastically flexed for positioning between said ribs and is held immobile by a spring force which results from its elastic flexure.

11. An improved accessory for a reusable paint bucket comprising a removable, disposable concave liner shaped to fit into and conform to the interior surface of a reusable paint bucket and including a floor and a wall rising upwardly from said floor, a stiff transverse floor rib projecting upwardly from said floor, at least a pair of stiff parallel wall ribs located on said wall in spaced separation from each other and both residing in mutually coplanar relationship with said floor rib, and further comprising a flat rolling screen removably insertable into said liner and held immobile therewithin by said floor rib and said wall ribs.

12. An accessory according to claim 11 wherein said liner floor is flat and said wall ribs are oriented at an acute angle relative thereto.

13. An accessory according to claim 11 wherein said liner is of uniform thickness throughout.

14. An accessory according to claim 13 wherein said liner is shaped to fit into and conform to the interior surface of a five gallon bucket.

15. An accessory according to claim 13 wherein said liner is shaped to fit into and conform to the interior surface of a two gallon bucket.

* * * * *